US009917357B2

(12) United States Patent
Tanaka et al.

(10) Patent No.: US 9,917,357 B2
(45) Date of Patent: Mar. 13, 2018

(54) ANTENNA SYSTEM

(71) Applicant: Sony Corporation, Tokyo (JP)

(72) Inventors: Masato Tanaka, Chiba (JP); Hideaki Shoji, Tokyo (JP); Aiko Yoshida, Tokyo (JP)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 302 days.

(21) Appl. No.: 13/911,765

(22) Filed: Jun. 6, 2013

(65) Prior Publication Data

US 2014/0361948 A1 Dec. 11, 2014

(51) Int. Cl.

| | |
|---|---|
| ***H01Q 1/38*** | (2006.01) |
| ***H01Q 1/24*** | (2006.01) |
| ***H01Q 9/04*** | (2006.01) |

(52) U.S. Cl.

CPC ..... *H01Q 1/38* (2013.01); *H01Q 1/243* (2013.01); *H01Q 9/0457* (2013.01)

(58) Field of Classification Search

CPC ..... H01Q 1/50; H01Q 1/38; H01Q 1/243; H01Q 9/0457

USPC ..... 343/700, 702, 861

See application file for complete search history.

(56) References Cited

U.S. PATENT DOCUMENTS

| | | | | |
|---|---|---|---|---|
| 5,764,189 | A * | 6/1998 | Lohninger | G01S 7/032 333/246 |
| 5,874,926 | A * | 2/1999 | Tsuru et al. | 343/860 |
| 6,469,590 | B1 * | 10/2002 | Lewis et al. | 333/17.3 |
| 7,301,502 | B2 | 11/2007 | Sinasi et al. | |
| 7,602,341 | B2 * | 10/2009 | Wei-Shan et al. | 343/700 MS |
| 7,825,863 | B2 * | 11/2010 | Martiskainen et al. | 343/702 |
| 7,932,865 | B2 | 4/2011 | Wong et al. | |
| 7,990,321 | B2 | 8/2011 | Shih | |
| 9,007,266 | B2 * | 4/2015 | Hsu et al. | 343/702 |
| 2007/0262906 | A1 * | 11/2007 | Haim | H01Q 1/2266 343/700 MS |
| 2011/0298669 | A1 * | 12/2011 | Rao | H01Q 1/243 343/702 |

* cited by examiner

*Primary Examiner* — Graham Smith
*Assistant Examiner* — Noel Maldonado
(74) *Attorney, Agent, or Firm* — Oblon, McClelland, Maier & Neustadt, L.L.P.

(57) ABSTRACT

Discussed herein is an antenna system that comprises a feed element and a radiating element that are formed on a dielectric substrate positioned above a circuit board which includes a feed circuit and a ground layer. Specifically, the feed element is disposed within an outer periphery defined by the radiating element. A capacitive coupling is formed between the feed element and the radiating element. With the aforesaid configuration, the antenna system is less affected by the circuit board and interference from other elements that are mounted on the circuit board. Further, manufacturing costs are reduced as compared to the case where the feed element and the radiating element are respectively formed on a front and rear surface of a resin layer.

20 Claims, 11 Drawing Sheets

ANTENNA SYSTEM

BACKGROUND

Field of the Disclosure

This disclosure relates to an antenna system comprising of an electric power feeding element and a radiating element arranged in a three dimensional space with respect to a circuit board.

Description of the Related Art

Conventional antenna systems comprise of a feed element and a radiating element that are incorporated in the same layer as a circuit board of a mobile phone device or the like. Usually, the electric power feeding element and the radiating element are positioned in such a manner, such that they at least partially overlap, thereby creating a capacitive coupling. The radiating element thereby emits the current transmitted from the power feed element as a radio wave through this capacitive coupling.

Traditional antenna systems position the radiating element around the electric power feeding element and also include the capabilities to adjust the capacitive coupling value (i.e., the electrostatic capacitance formed by the feed element and the radiating element). Hence, in such a system the parameters that influence the coupling such as the distance between the electric power feeding element and the radiating element, the length of a proximity contact part and the like are important design parameters that need to be accounted for while manufacturing such a device.

Specifically, precise manufacturing steps need to be taken while positioning the power feed element and the radiating element. The manufacturing is usually performed by 'etching' on a circuit board the respective positions of the feed and radiating elements. Note that in such a manufacturing mechanism, the feed and radiating elements are positioned (along with other components) on the same layer of a circuit board. In doing so, the performance of the antenna system tends to deteriorate due to the influence of circuit components interfering with the radiating and feed elements.

Further, to avoid the drawbacks of the interference caused by circuit elements, a resin layer is provided above the circuit board, wherein the radiating element is positioned on one side of the resin layer and the feed element is position on the other side. However this arrangement increases the thickness of the mobile device and thus increases the manufacturing costs.

Accordingly, in the present disclosure an antenna system that avoids the interference from other circuit elements and keeps manufacturing costs low is described.

SUMMARY

Devices that comprise of an antenna system which is positioned three-dimensionally with respect to the circuit board of the device is described.

According to one exemplary embodiment, the disclosure is directed to an antenna comprising: a circuit board including a feed circuit and a ground terminal; a radiating element formed on a dielectric substrate positioned above the circuit board; a feed element formed on the dielectric substrate, the feed element disposed within an outer periphery defined by the radiating element; a first conductive element that connects the feed element to the feed circuit; and a second conductive element that connects the radiating element to the ground terminal.

According to another exemplary embodiment, the disclosure is directed to a terminal device comprising: a circuit board including a feed circuit and a ground terminal; an antenna unit including a radiating element formed on a dielectric substrate positioned above the circuit board; and a feed element formed on the dielectric substrate, the feed element disposed within an outer periphery defined by the radiating element; a first conductive element that connects the feed element to the feed circuit; and a second conductive element that connects the radiating element to the ground terminal.

The foregoing general description of the illustrative implementations and the following detailed description thereof are merely exemplary aspects of the teachings of this disclosure, and are not restrictive.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 1A-1C depict the front, side and bottom view of the device;

DETAILED DESCRIPTION

Figure 1A:
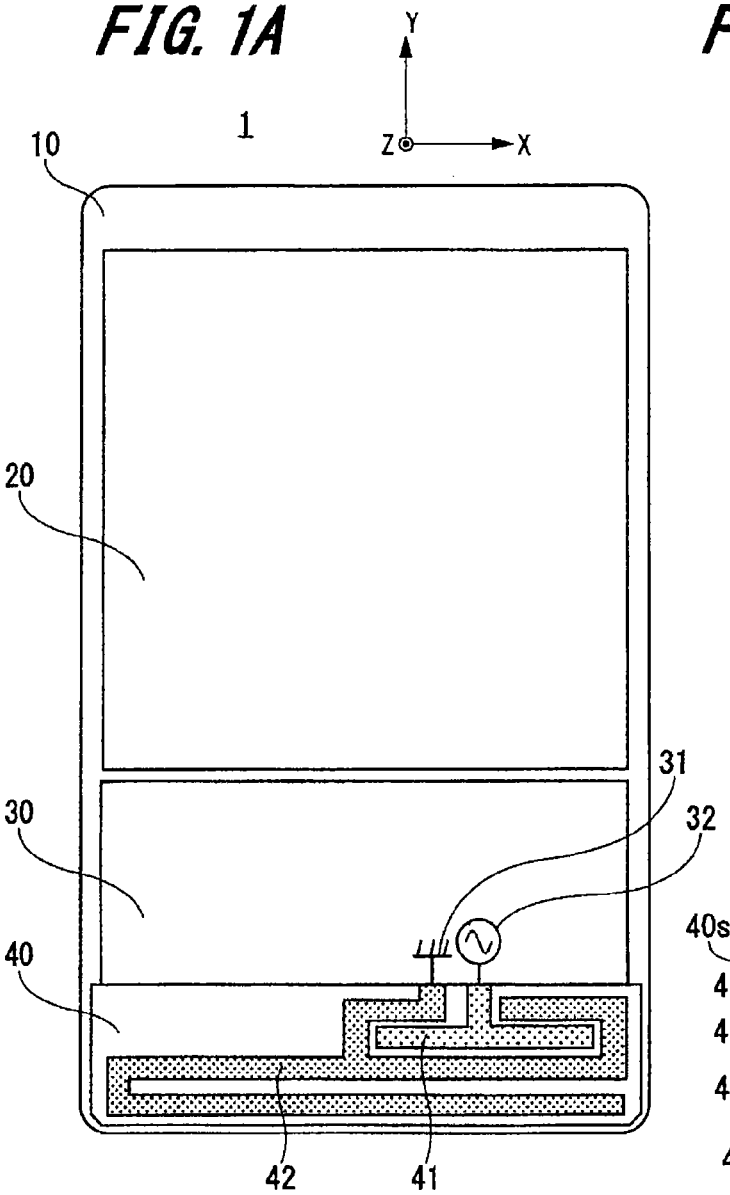
FIGS. 1A-1C illustrate schematically a structure of a mobile phone device that comprises an antenna system. Specifically.

Referring now to the drawings, wherein like reference numerals designate identical or corresponding parts throughout the several views.

Figure 1B:
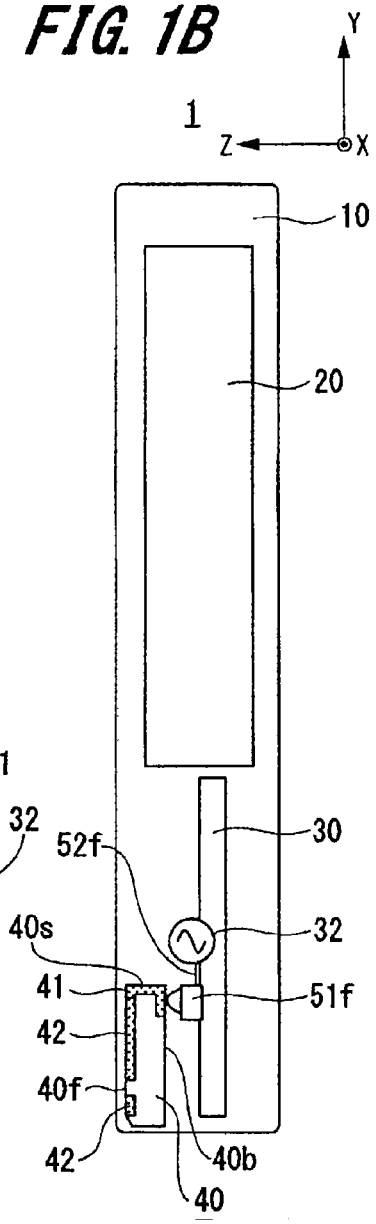
Figure 1C:
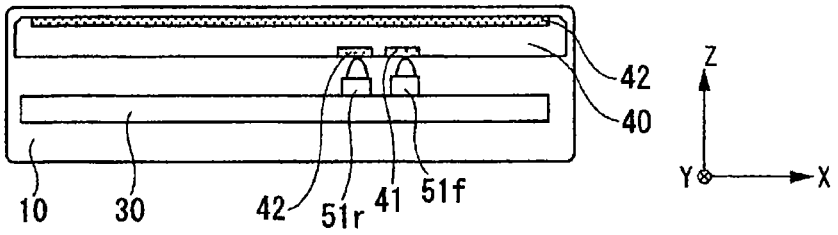

FIGS. 1A-1C illustrate the structural elements of an antenna system that is comprised within a mobile phone device or the like. FIG. 1A depicts a frontal view (of the rear surface of the mobile phone), FIG. 1B depicts the side view and FIG. 1C depicts the bottom view of the mobile phone device. Note that in these figures the length of the mobile phone (longitudinal length) is represented along the Y-axis, the width of the phone is represented along the X-axis and the depth (thickness) of the mobile phone is represented along the Z-axis.

FIG. 1A depicts a battery 20 and a circuit board 30 that are positioned above one another and enclosed in a mobile casing 10. The circuit board is equipped with a ground terminal 31 and a feed circuit 32. The electric power feeding circuit 32, generates power and supplies it to a power feeding element 41, which also comprises a matching circuit. Further, the ground terminal is connected to a radiating element 42, which along with the feed element 41 is arranged on a resin housing 40 which is positioned above the circuit board in the Z-direction. In other words, the circuit board and the resin housing (that includes the electric power feeding element 41 and the radiating element 42) are arranged in a three dimensional space with respect to each other. Note that ground terminal 31 and the feed circuit 32 are comprised within the circuit board 30. The power feed element 41 and the radiating element 42 are formed by plating or printing a metal on the housing resin 40.

As shown in FIG. 1C, the housing resin 40 and the circuit board 30 are connected to each other via an electric power feeding connection spring 51*f* and a radiating element connection spring 51*r*. Note that both the springs are attached to the circuit board and include an electro-conductive member. As the connection springs 51*f* and 51*r* extend, the direction of the elastic force exerted is transferred to the housing resin 40, which in turn presses against the mobile casing 10. Note that the position of the housing resin 40 can alternatively be fixed to the mobile casing 10 by inserting an outer peripheral part of the housing 40 such as a nail/claw.

As shown in FIG. 1B, the electric power feeding element 41 and the radiating element 42 are formed not only on the surface 40*f* of the resin housing but also on the surfaces 40*s* (side) and 40*b* (back). Further, the electric power feeding element 41 formed on the back surface 40*b*, connects with a front end (tip) of the power feeding connection spring 51*f*. In a similar manner, the radiating element 42, connects with the radiating element connection spring 51*r*.

The springs 51*f* and 51*r* connect to the power feeding element 41 and the radiating element 42 respectively, through a feed line 52*f* and a ground line 52*g* that are formed by etching on the circuit board 30. The electric current generated in the feeding element 32 is transferred to the connection spring 51*f* through the feed line 52*f*, which is further transmitted to the power feeding element 41. The current from the feed element 41 is transferred to the radiating element 42 (as an electromagnetic wave) through a capacitive coupling that is formed between the elements 41 and 42.

For the sake of representation, in FIG. 1A, the electronic power feed element 41 is represented to have a 'T' shape. Note that the periphery of the feed element 41, is completely enclosed by the radiating element 42. As stated previously, in doing so, an electrostatic capacitance is achieved.

Further, the feeding element 41 and the radiating element 42 use the capacitive coupling also as a constant of the matching circuit of the antenna system. The area where the electrostatic capacitance is used as a constant of a matching circuit, is referred to as a 'capacitive coupling part'. Note that the inductance generated in the ground terminal 31, can also be used as a constant of the matching circuit. Hence, it is preferable to keep the distance between the power feed element 41 and the feed circuit 32, and the distance between the radiating element 42 and the ground terminal 31, to a quarter of the length of the operating frequency band of the mobile phone device.

Figure 2:
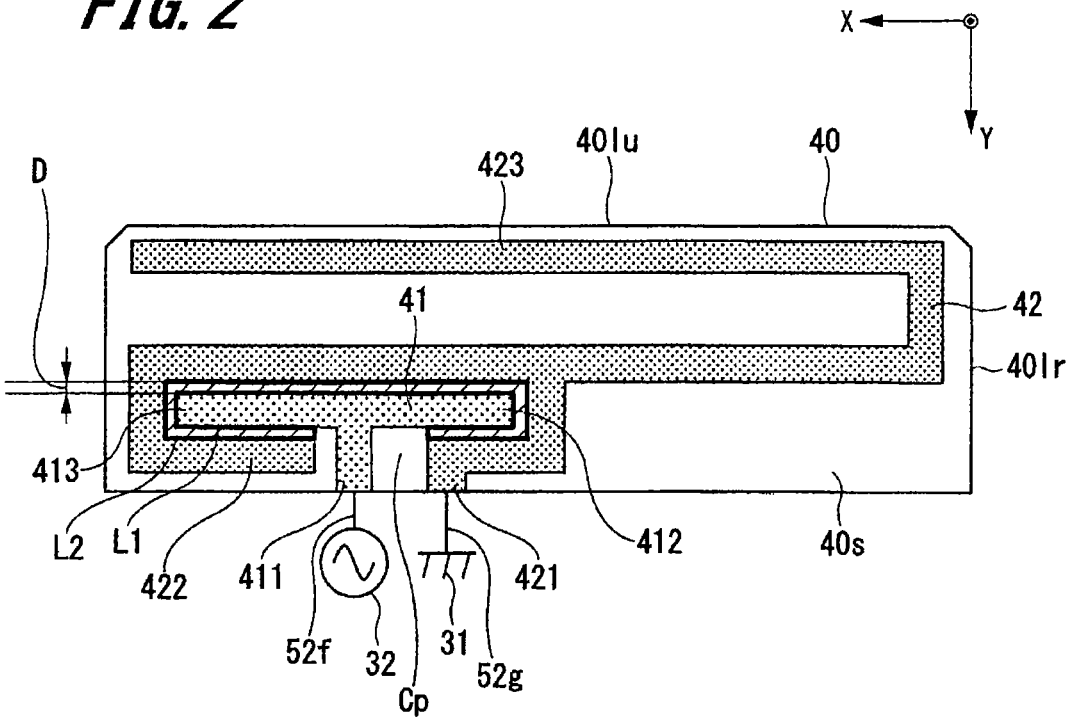
FIG. 2 illustrates the formation of a capacitive coupling in an antenna.

FIG. 2 depicts a configuration of the layout of the housing resin 40 that comprises the electric power feeding element 41 and the radiating element 42. The electric power feeding element 41 comprises a base part 411, and two edge parts (tips) 412 and 413 respectively. The base part 411 is connected to the electric power feeding circuit 32 through the power feeding connection spring 51*f* (shown in FIGS. 1B and 1C). The ends 412 and 413 branch in either direction from the base part 411 forming a T shaped bar. The radiating element 42 comprises a base part 421, a capacitive coupling part 422 and a radiation part 423. The base part 421 is grounded (connected) to the ground terminal 31 through a radiating element connection spring 51*r* (shown in the FIG. 1C).

The capacitive coupling 422, is formed by an extension of the base part 421 that encloses the edges 412 and 413 of the power feed element. Note that in the example depicted in FIG. 2, the capacitive coupling 422 is formed by parts of the radiating element 42 enclosing the T-shaped power feed element at five sides/surfaces. The radiation element 423, is formed as an extension (branch) of the base part 421 of the radiating element and is aligned on the edges of the housing resin 40. Specifically, he radiation element comprises a part 423, that is positioned in parallel with the outer edge 401*r* (on the right side) and a top edge 401*u* of the housing resin 40.

The capacitive coupling, Cp, is formed between the inner peripheral side of the radiating element 42 and the outer periphery of the electric power feeding device 41. The capacitive coupling area is shown with an oblique line in FIG. 2 and can be considered as a capacitive coupling that comprises a parallel plate and the electrostatic capacitance of value C which can be calculated as follows:

$$C = \frac{\varepsilon S}{d} \tag{1}$$

wherein ∈ is the dielectric constant between the electric power feeding device 41 and the radiating element 42, S is the area of the capacitive coupling, and d represents the distance between the inner peripheral edge of the capacitive coupling part 422 and the outer periphery of the electric power feeding device 41.

Note that the area S of the capacitive coupling can be calculated by using the thickness (depth) T of the coupling part Cp, along with the peripheral length L of the capacitive coupling part Cp. Note that the peripheral length L of the capacitive coupling 422, is the length which comprises the area of the capacitive coupling part. Specifically it could be the average length of the outer peripheral side L1 of the electric power feeding device 41, and the inner peripheral side L2 of the radiating element 42. The capacitive coupling Cp performs a function similar to a capacitor that is connected to a signal part in a series configuration in a matching circuit. Thereby, if a plurality of capacitive elements (of capacitive value C) are taken in to account for incorporating the capacitive coupling Cp, the value of the capacitive matching circuit and the electric power feeding circuit 32 can be decreased.

Further, note that in order to enlarge the capacitive coupling value C, of the capacitive coupling part Cp, either the effective area S is increased or correspondingly the distance d is decreased. The area S is calculated by multiplying the thickness T of the electric power feeding device 41 and the length L which comprises the area of the capacitive coupling part Cp. Since the frequencies of the electromagnetic waves are in the microwave band of 800 MHz to 1.5 GHz, an electrostatic capacitance value that is approximately in the range of 0.1 picofarads to 5 picofarads is preferable. When the dielectric constant c of the capacitive coupling part Cp is approximately 2.6562 and $10^{-11}$ and the thickness T of the electric power feeding device 41 is approximately 30 micrometers the variable in (1) is the distance and the length d, L respectively, which comprises the area S.

In order to achieve a capacitance value of 0.1 picofarads (pF), when the distance d is approximately 0.05 mm, a length L, of approximately 7 mm is required. Note however that it is difficult to achieve a precise value of capacitance by performing the plating or the printing process of the power feeding element 41 and the radiating element 42 on the housing resin 40. Specifically to obtain a precision in the thickness of the capacitive coupling unit is very difficult. As fluctuations in manufacturing occur, they correspondingly affect either the length L or distance d and hence affect the desired capacitance value.

When there is a variation in the distance d due to the variation in the manufacture of the electric power feeding device 41 and the radiating element 42, the influence of this manufacturing variation can be suppressed to 10%. Specifically if it is assumed that the variation in distance is approximately 0.03 mm, the distance d can be 0.3 mm then a length L of approximately 38 mm is required in achieving the desired capacitance. The influence brought about by manufacturing variations can further be reduced such that the distance d (between the outer surface of the feed element and the inner surface of the radiation element) is enlarged while the length L is not lengthened. Doing so achieves a higher value of the capacitive coupling C.

Figure 3:
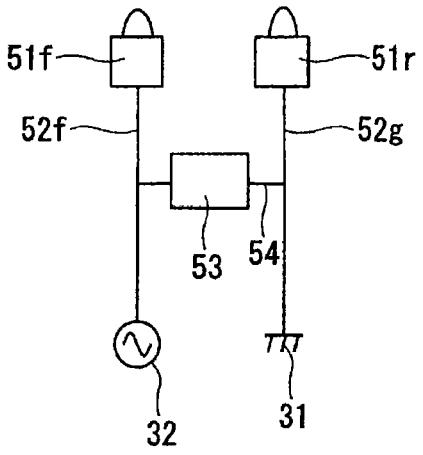
FIG. 3 is a schematic of a circuit depicting a coupling adjustment element.

Moreover, when the capacitive coupling Cp is desired to acquire a value of 5 pF, the restriction with respect to distance d and L are more stringent. According to the present disclosure, by providing an adjustment element which supplements the capacitive coupling, the influence of manufacturing variation is reduced and thereby providing freedom to design the antenna system FIG. 3 is a circuit diagram illustrating a non-limiting example of the arrangement of a coupling adjustment element. The coupling adjustment element 53 is provided on a transmission line 54. The transmission line 54 is a line that connects the ground line 52*g* and the feed line 52*f*. Note that the ground line 52*g* is connecting the ground terminal 31 to the radiating element connection spring 51*r*, and the feed line 52*f*, is the line connecting the feed circuit 32 to a power feeding connection spring 51*f*. Note that the transmission line 54 is formed by 'etching' on the circuit board 30.

The coupling adjustment element 53 can comprise, for example, a capacitor. Specifically, the coupling adjustment element 53 can serve a similar function as a capacitor that is parallely connected with respect to the coupling C that is formed in the capacitive coupling part. In other words, the electrostatic capacitance value that is acquired by an antenna element can be represented as C', which can be calculated as follows:

$$C'=C+C2 \tag{2}$$

wherein C2 is the electrostatic capacitance value of the coupling adjustment element 53 and C is the capacitance that is obtained by varying the size and shape of the electric power feeding device 41 and radiating element 42. Thus, it is possible to adjust the electrostatic capacitance value C' that is secured by the antenna element by providing a coupling adjustment element 53 in addition to the adjustment of the coupling amount C.

Furthermore since electrostatic capacitance value C' can be adjusted by the element 53 it is possible to increase the distance d, the space (separation) between the electric power feeding element 41 and the radiating element 42. Hence, by increasing the distance, the influence of manufacturing variations on the electric power feeding device 41 and radiating element 42 can be minimized.

Figure 4:
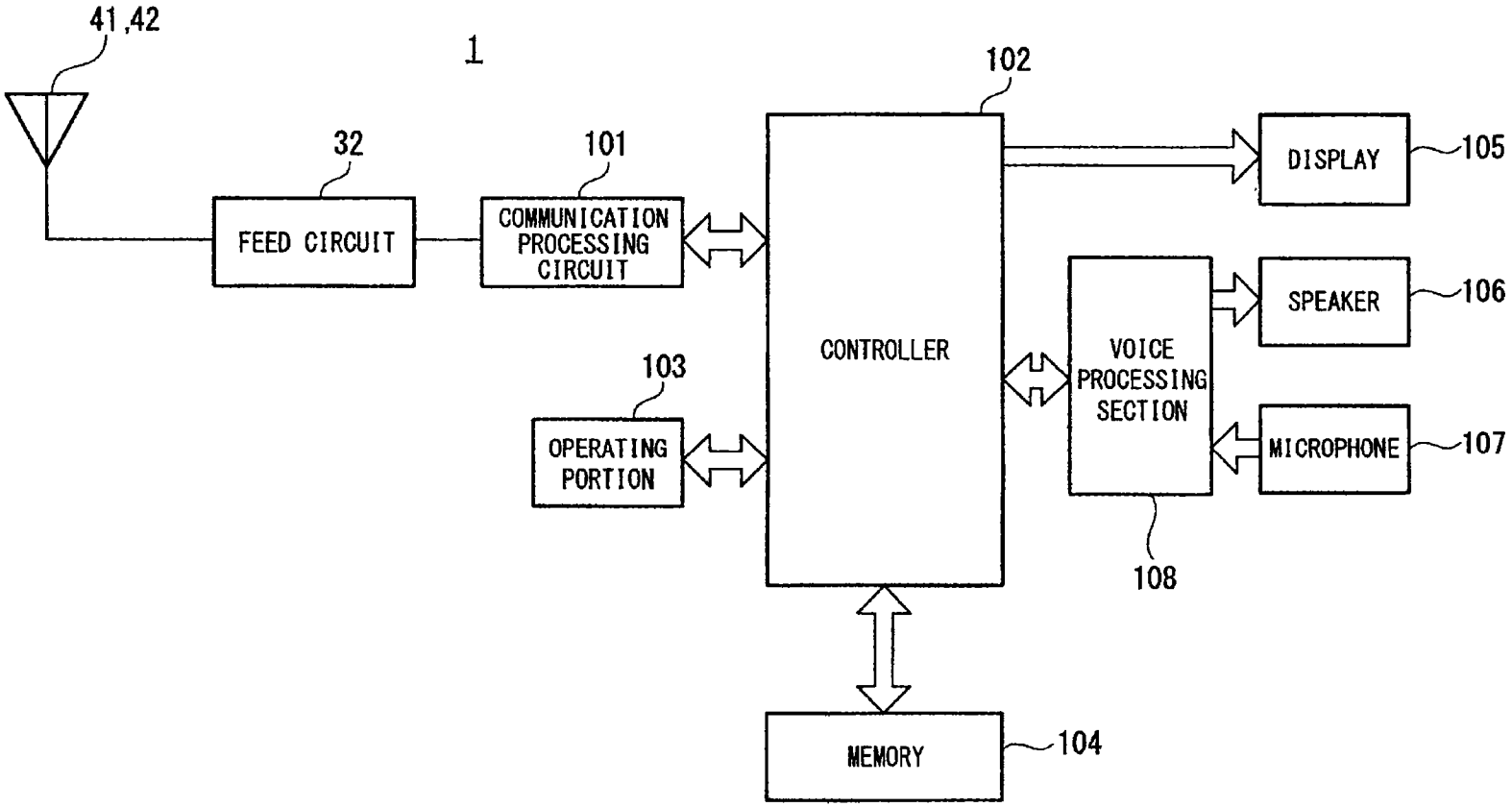
FIG. 4 depicts a non-limiting block diagram of the internal structure of a mobile phone device.

FIG. 4 is a non-limiting example depicting the internal structure of a mobile phone terminal device 1. The mobile phone terminal device is equipped with an antenna element that comprises an electric power feeding device 41, a radiating element 42 and the electric power feeding circuit 32. Moreover the mobile phone device 1 is equipped with a communication processing circuit 101, a controller unit 102, an operation unit 103, a memory unit 104, a display 105, speakers 106, a microphone 107, and a speech processing unit 108.

The communication processing circuit 101 performs operations on signals received by the antenna element. Specifically it modulates the signal (audio/voice signal, image signal) and demodulates the high frequency signal components by which the adjustment was taken by the electric feeding circuit 32. The control unit 102 is, for example, a central processing unit (CPU) that controls each function in the mobile phone terminal device 1. The operation unit 103 generates an operation signal according to the operation that is input by a user and outputs it to the control unit 102. The memory unit 104 is essentially a read only memory (ROM), or a random access memory (RAM). The data which was received from by the mobile terminal is stored in the ROM. Note however, that while the RAM is used as a working memory, data can be temporarily stored in the RAM for the case when the control unit 102 performs control processing. The display unit 105 is a liquid crystal panel display or an organic electroluminescence panel. The display regarding a transmission and/or reception/termination of a telephone call is given to the display part 105. In a similar manner when an image or an audio/video is downloaded, the corresponding contents are displayed at the display unit 105 of the mobile phone terminal device 1.

The speaker 106 and the microphone 107 are connected to a speech processing unit 108. The speech processing unit performs a modulation of an audio signal that is input by the microphone and upon further processing transfers the processed signal to the antenna system for transmission. In a similar manner, input signals received by the antenna system are forwarded to the voice processing unit, wherein upon further processing the signals are transmitted to the user via the speaker 106.

Figure 5:
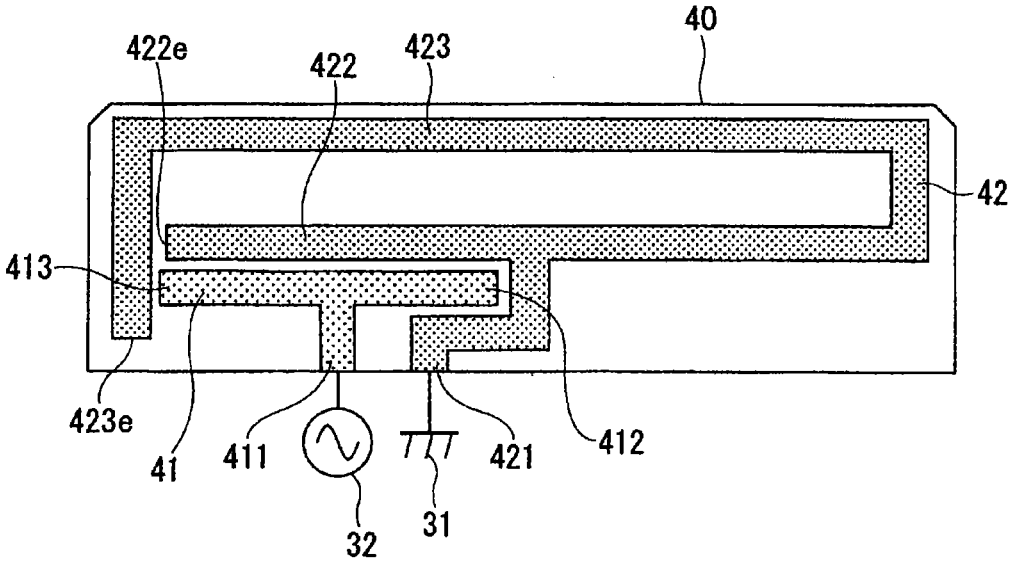
FIG. 5 illustrates the configuration of a feeding element and a radiating element according to a first embodiment of the disclosure.

FIG. 5 depicts according to a first embodiment of the present disclosure the configuration of the electric power feeding element 41 and the radiating element 42. The electric power feeding element 41 is of a T-shaped form similar to that as depicted in FIG. 1 and FIG. 2. The base end 411 of the electric power feeding element 41 is connected to the electric power feeding circuit 32 through the power feeding device connection spring 51*f* (not shown in the figure). The front ends 412 and 413 of the electric power feeding element 41 branch in a direction from either side of the base end 411 forming a T-shaped bar. The radiating element 42 is positioned in such a manner that the capacitive coupling part 422 encloses the outer periphery at three sides of the power feeding element. Specifically the base part 421 (of the radiating element 42) encloses the circumference of the front end 412 that comprises the right side of the T-shaped bar. Similarly the radiating element encloses the feed element 41 on the left side of the T-shaped bar. Note that the top surface of the feed element which is enclosed by the radiating element 422 is the capacitive coupling unit.

Further, a part of the radiation element 423, is formed by branching from the middle of the base part 421 and is positioned along the outer periphery of the housing resin 40. The front-end 423*e* of the radiating element is positioned in the front of 413 of the electric power feeding element 41. Note that in the configuration of FIG. 5 there are two alternate parts for transmitting the current from the feed circuit to the radiating element. The first path is in an anticlockwise direction, wherein the current is transmitted from part 412 of the feed circuit element to the radiating element to the right end of the T-shaped bar. Contrarily, the current can be transferred in a clockwise direction from the left end 413 of the feed element 41, to the radiating element 42. Note that both these paths differ in track lengths and hence the wavelengths (frequencies) that resonate within them also differ. Hence by positioning the electric power feeding element 41 and the radiating element 42 in the manner as described in FIG. 5 the user can achieve a multiband resonance antenna system.

Figure 6:
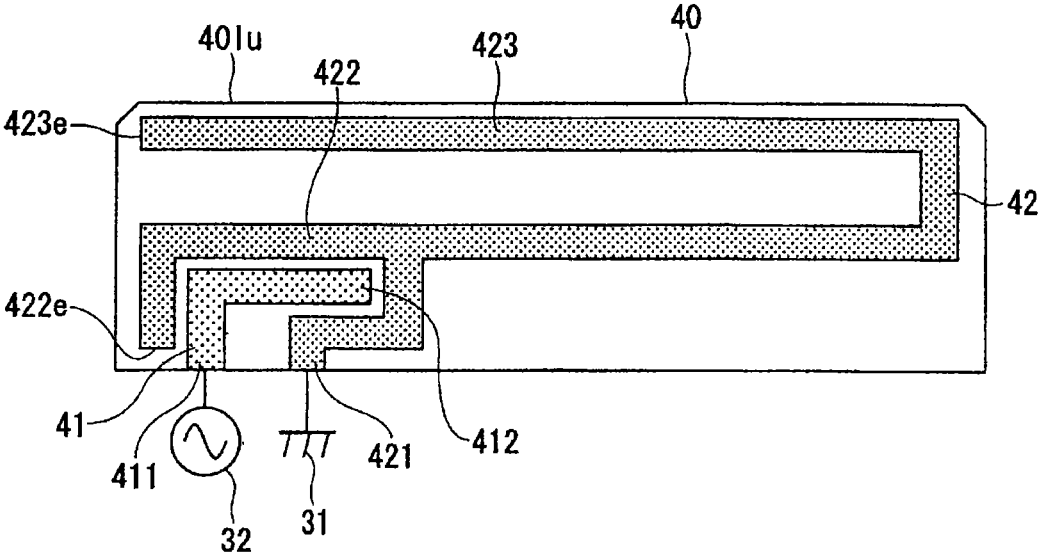
FIG. 6 illustrates the configuration of the feeding element and the radiating element according to a second embodiment of the disclosure.

FIG. 6 describes according to a second embodiment of the present disclosure the configuration of the electric power feeding element and the radiating element that are comprised in an antenna system.

Note that in this embodiment the power feeding element 41, is L shaped. Similar to FIG. 5, the base end 411 of the electric power feeding element 41 is connected to the power feeding circuit 32 through an electric power feeding connection spring 51*f*. The radiating element 42 is positioned in a manner such that the capacitance coupling part 422 encloses the outer periphery at four sides of the power feeding element 41. Specifically as shown in FIG. 6, note that the L-shaped feeding element is enclosed by the radiating element on the top, bottom, left and right ends. The radiation part 423 is formed by branching from the middle of the base end 421 (of the radiating element 42) and is positioned along the outer periphery of the housing resin 40. The front end 423*e* of the radiation unit 423 is positioned to the left end of the edge 401*u* above the housing resin 40. Note that by making the electric power feeding device 41 into an L shape it becomes possible to reduce the horizontal (X-axis length) from the left edge of the circuit board to the power feeding circuit 32 and thus provides additional freedom in designing the antenna system.

Figure 7:
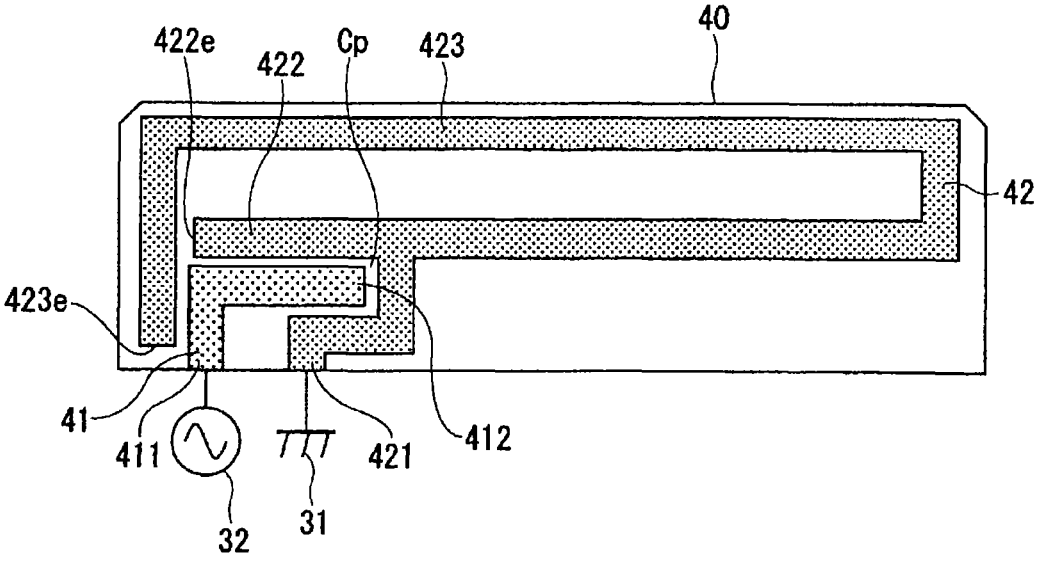
FIG. 7 illustrates the configuration of the feeding element and the radiating element according to a third embodiment of the disclosure.

FIG. 7 illustrates according to another embodiment of the present disclosure a configuration of the electric power feeding element and the radiating element that are comprised within an antenna system.

As shown in FIG. 7, the electric power feeding element 41 is L shaped, similar to that as depicted in the example shown in FIG. 6. Further, similar to the capacitive coupling of FIG. 5, the capacitive coupling 422 (of the radiating element 42) is positioned such that the periphery at three sides of the electric power feeding element 41 are enclosed. Note however, that the front end 423*e* of the radiation element 423 is positioned in the vicinity of the left side of the electric power feeding element 41. In doing so, a flexibility in designing the antenna system is obtained while achieving the effects of a multiband-resonance system.

Figure 8:
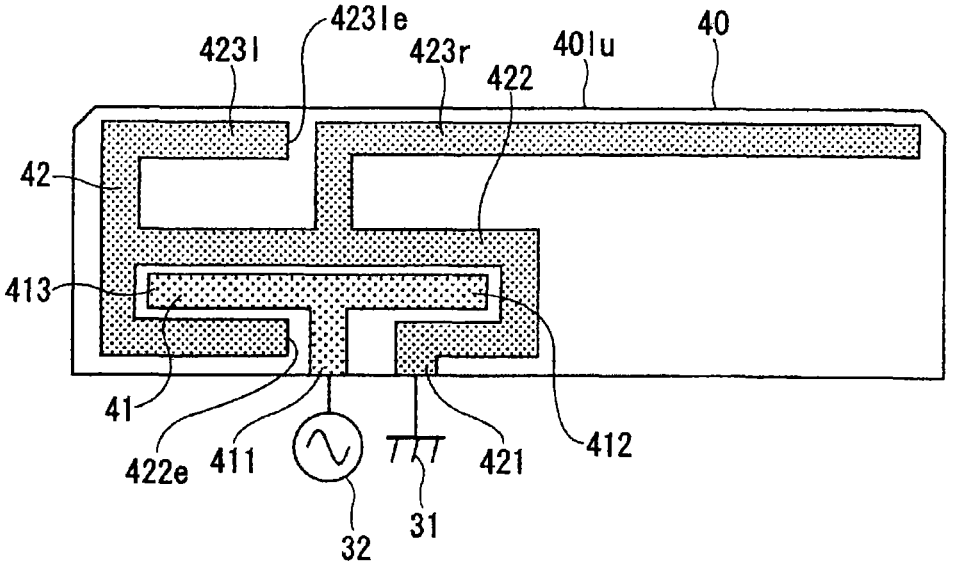
FIG. 8 illustrates the configuration of the feeding element and the radiating element according to a fourth embodiment of the disclosure.

FIG. 8 depicts according to another embodiment of the present disclosure the configuration of the electric power feeding element and the radiating element. In this embodiment the electric power feeding element 41, is T-shaped similar to that of FIG. 5. The capacitive coupling part 422 (of the radiating element 42) is positioned in such a manner such that the periphery at five sides of the electric power feeding device 41 are enclosed. Specifically, the base part 421 encloses the bottom part of the feed element 41. Similarly the left and right end of the power feed elements are enclosed and the front end of the radiating element 422*e* is positioned underneath the left arm of the T-shaped power feed element. The radiation element part 423 (of the radiating element 42) branches into two parts, depicted as 423*r* and 423*l* of varying lengths. The radiation element 423*r* is positioned in the middle of the capacitive coupling formation part 422 and extends (branches) in a direction parallel to the edge 401*u*, of housing resin 40. In a similar manner the left branch of the radiation element 42 branches from the center of the feed element towards the left end of the resin housing 40 and is positioned in the top left corner 423*l*. This shape of the radiation element is referred to as a 'two-branch' shape. Note that when the electric power feeding element 41 is made into an L shape the positioning in the horizontal direction of the housing resin 40 can be adjusted as desired.

Figure 9:
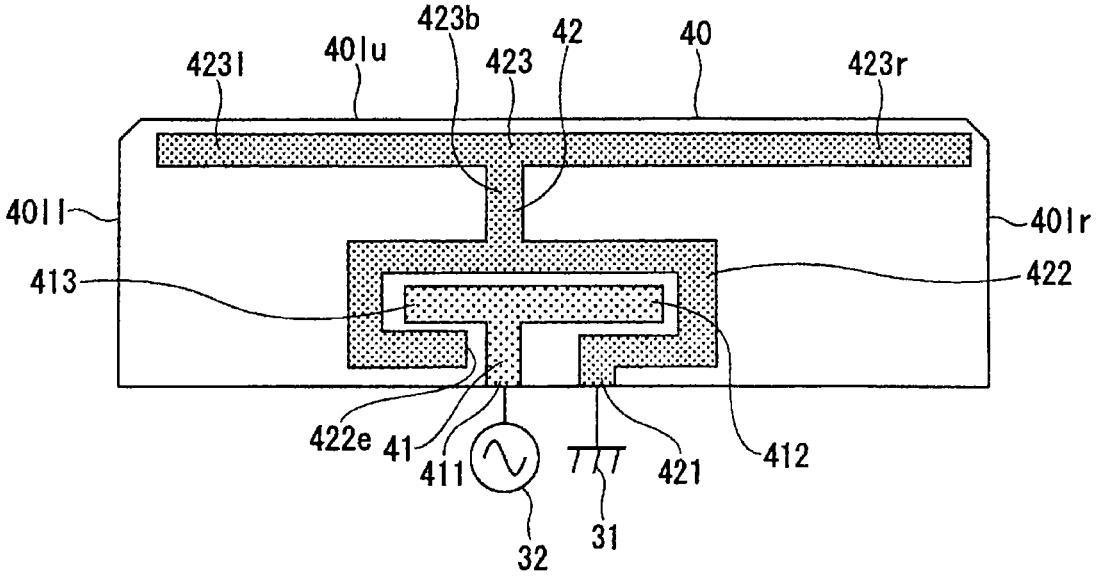
FIG. 9 illustrates the configuration of the feeding element and the radiating element according to a fifth embodiment of the disclosure.

FIG. 9 illustrates according to another embodiment of the present disclosure the configuration of the electric power feeding element and a radiating element. Note that in FIG. 9, the shape of the radiation element 423 is in a T-shaped form. The capacitive coupling part 422 (of the radiating element 42) is positioned in a manner such that the periphery of the power feeding device 41 is enclosed at five sides. Note that the shape of the capacitive coupling formation part 422 as shown in FIG. 9 is substantially of the same form as that shown in FIG. 8. The radiation part 423 consists of a base part 423*b* and a left and right arms denoted by 423*l* and 423*r* respectively. The radiation element part 423 emerges from the center of the coupling formation part 422 and branches towards the left (423*l*) and right (423*r*) end of the resin housing. This shape is referred to as a 'T-branch' radiating element.

Figure 10:
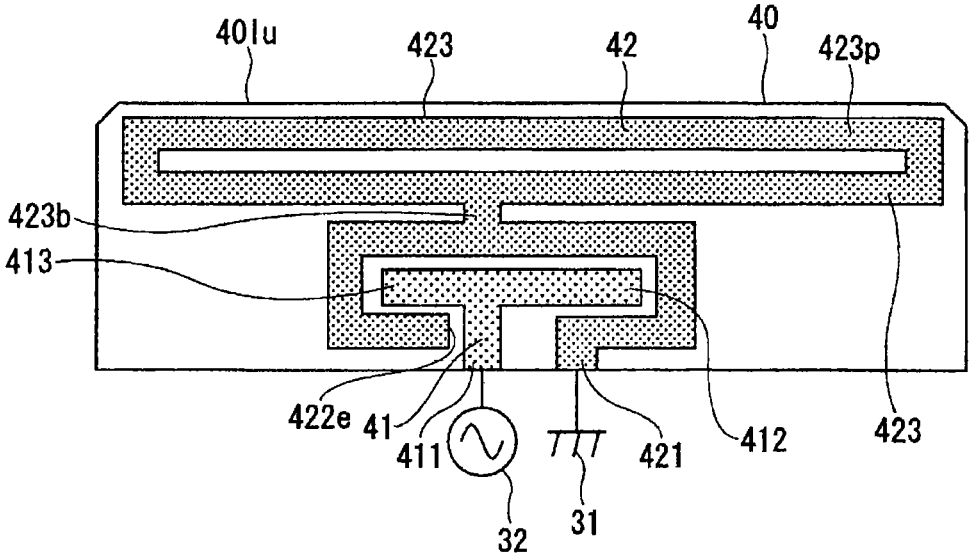
FIG. 10 illustrates the configuration of the feeding element and the radiating element according to a sixth embodiment of the disclosure.

FIG. 10 illustrates according to another embodiment of the present disclosure the configuration of the electric power feeding element and the radiating element that constitute an antenna system. FIG. 10 depicts the example wherein the shape of the radiation element part 423 (of the radiating element 42) is a T-shape. Note that the horizontal bar of the T-shaped radiating element, is in form of a loop. The capacitive coupling formation part 422 of the radiating element 42 is positioned in a manner such that the periphery of the power feeding device 41, is enclosed at five sides.

Note that the shape of the capacitive coupling formation part is substantially similar to that of FIGS. 8 and 9. In the present example, the radiation element part 423 comprises of a hollow center. Specifically, the radiating element 423 comprises of a base 423*b* which emerges from the center of the capacitive coupling formation part 422 and forms a loop 423*b* with one side of the loop positioned along the surface of the resin housing 40.

Furthermore, it is to be noted that in the examples of FIGS. 5-10, the front end parts of the capacitive coupling formation 422 (of the radiating element 42) encloses the periphery of the electric power feeding device 41 on at least four sides. This however is not limiting the scope of the present invention. By lengthening the length of the T-shaped bar the electric power feeding element 41 (or the L-shaped bar), the area represented by parameter S in (1) can be enlarged. Note that as long as a sufficient value of S is obtainable, a decrease in the number of edges of the power feeding element 41 enclosed by the coupling formation part 422 can be reduced.

Figure 11:
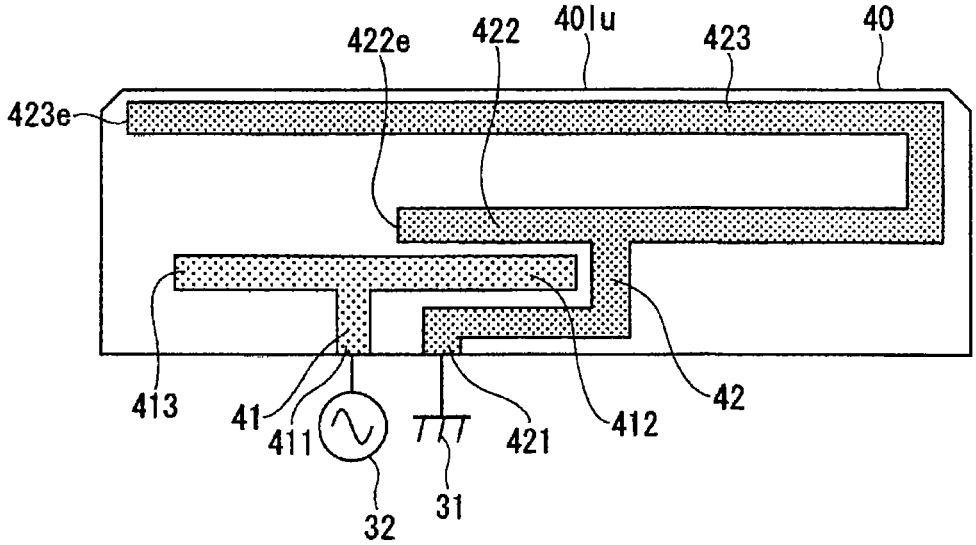
FIG. 11 illustrates the configuration of the feeding element and the radiating element according to a seventh embodiment of the disclosure.

FIG. 11 depicts according to another embodiment of the present disclosure a configuration of the electric power feeding element and a radiating element. In FIG. 11 the shape of the electric power feeding device 41 is a T shape. Contrary to the T-shaped power feeding element 41 of FIGS. 2, 5, 8 and 9, the T-shaped power feeding element of FIG. 11 has an elongated right bar. Thus, the capacitive coupling formation element 422 of the radiating element 42 adjusts the capacitive value by lengthening the length of the front part 412 that comprises the right side of the T-shaped bar. Hence, in this example the number of edges of the electric power feeding device 41 that is enclosed by the capacitive coupling formation part 422 are only three. Specifically, the lower part, the upper part, and the right-end part of the right arm of the T-shaped power feeding element are enclosed. Note that the base part of the power feeding element 411 and the left arm of the power feeding element 413 are not enclosed by the capacitive coupling part 422.

Figure 12:
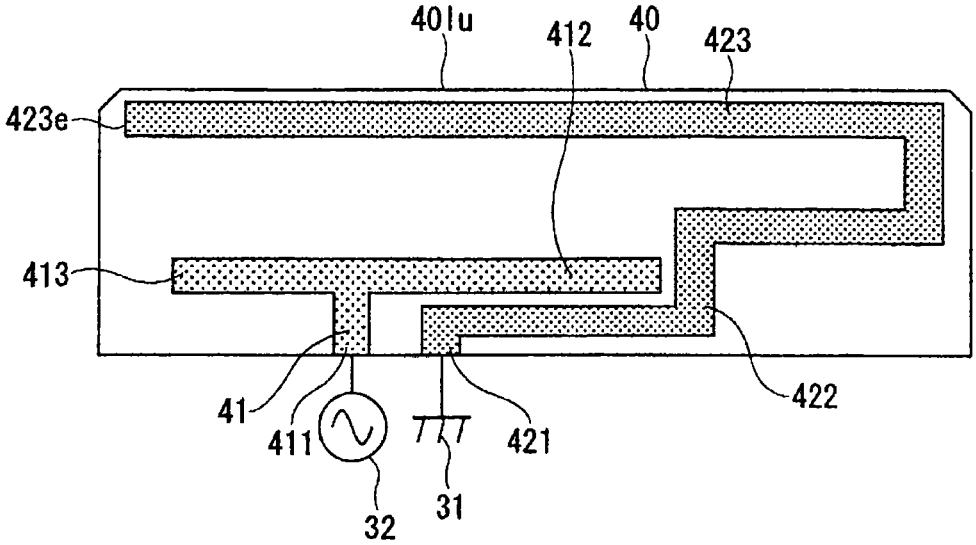
FIG. 12 illustrates the configuration of the feeding element and the radiating element according to a eighth embodiment of the disclosure.

FIG. 12 illustrates according to another embodiment of the disclosure the configuration of the power feeding element 41 and the radiating element 422. Contrary to the power feeding element 41 of FIG. 11, the power feeding element in FIG. 12 comprises of an elongated right arm of the T-shaped power feeding element 412. In doing so the effective area S of the capacitive value is increased and thus the radiating element 422 encloses only two sides of the power feeding element 41. Note that in FIG. 12 the lower side of the right bar of the power feeding element 41 and the front end tip denoted by 412 are enclosed by the radiating element. Similar to FIG. 11, the base part 411 and the front end of the left arm of the power feeding element 430 are not enclosed by the radiating element 422.

Figure 13:
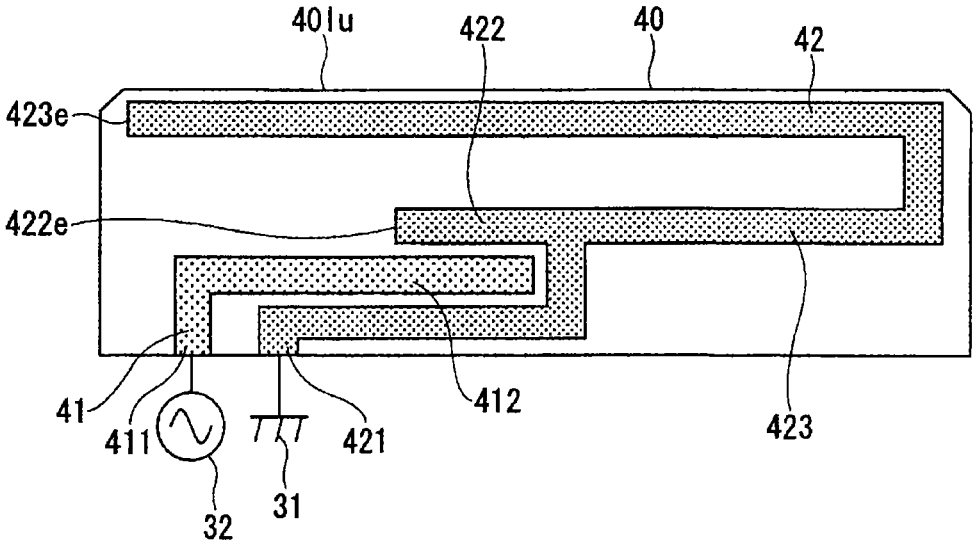
FIG. 13 illustrates the configuration of the feeding element and the radiating element according to a ninth embodiment of the disclosure.

FIG. 13 depicts according to another embodiment of the present disclosure the configuration of the electric power feeding element and the radiating element. As shown in FIG. 13, the electric power feeding element 41 is in the form of an L-shape, similar to the power feeding element of FIGS. 6 and 7. However, the length of the L-shaped bar of the power feeding element 41 is considerably longer than that of FIGS. 6 and 7. Hence, the number of edges (surfaces) that the electric power feeding element 41, is enclosed by the capacitive coupling formation element 422 is reduced. Specifically, only three sides need to be enclosed. The lower edge of 412 of the L-shaped bar, a part of the upper edge denoted by 422*e* and the front tip of the L-shaped bar are enclosed by the capacitive coupling formation part 422. Note that the base part 411 and the periphery of the front end tip of 412 are not enclosed by the capacitive coupling formation part 422.

Figure 14:
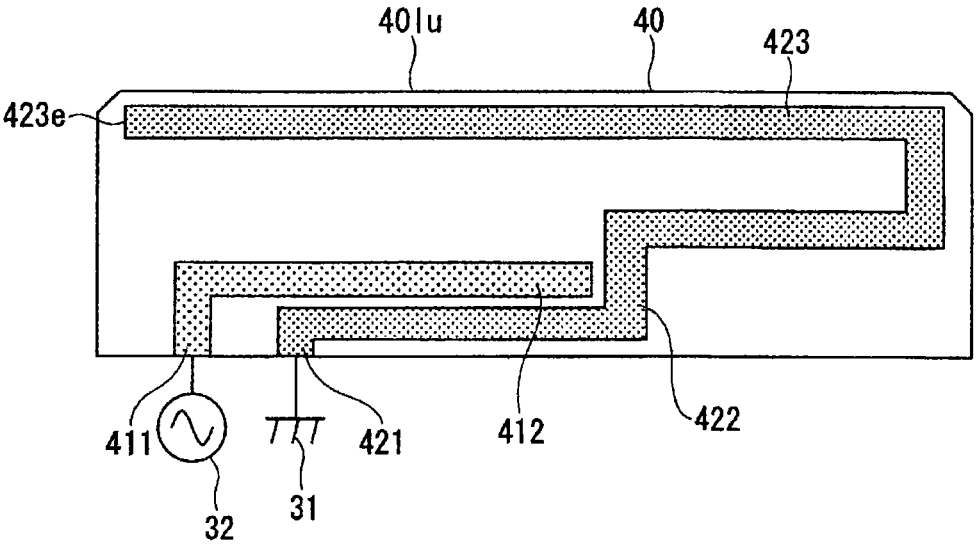
FIG. 14 illustrates the configuration of the feeding element and the radiating element according to a tenth embodiment of the disclosure.

In FIG. 14, an alternate embodiment of the present disclosure illustrates the configuration of the electric power feeding element and the radiating element. Note that the structure of the antenna system as depicted in FIG. 14 is similar to that as depicted in FIG. 13. However, the length of the L-shaped bar in FIG. 14 is considerably longer than the L-shaped bar as depicted in FIG. 13. This results in a reduction in the number of sides of the power feeding element 41 that need to be enclosed. As depicted in FIG. 14, only two surfaces of the power feeding element are enclosed by the capacitive coupling formation part 422 (of the radiating element 42). Specifically, the front tip 412 of the L-shaped bar and the bottom surface of the L-shaped bar are enclosed by the capacitive coupling formation. Similar to FIG. 13, the base part 411 of the L-shaped bar of the radiating element is not enclosed by the capacitive formation unit 422.

Figure 15:
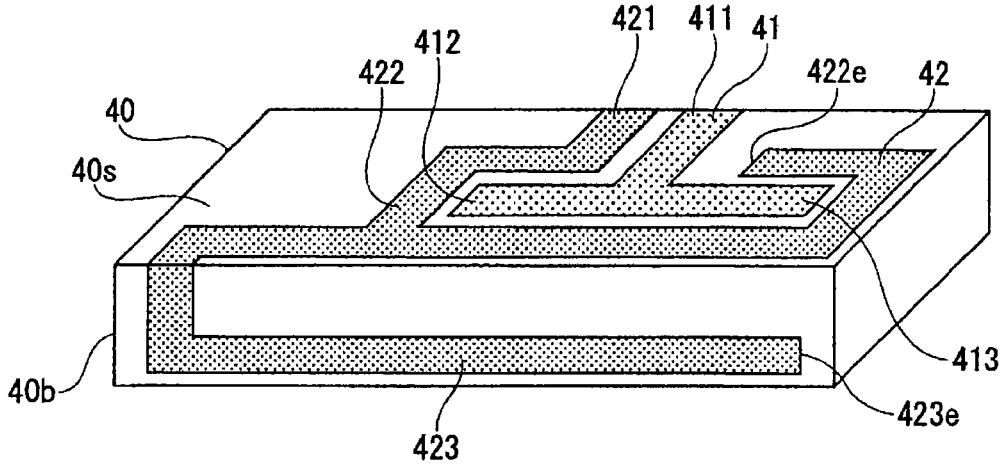
FIG. 15 illustrates an exemplary example depicting the configuration of the radiating element on multiple sides of a housing resin.
Figure 16:
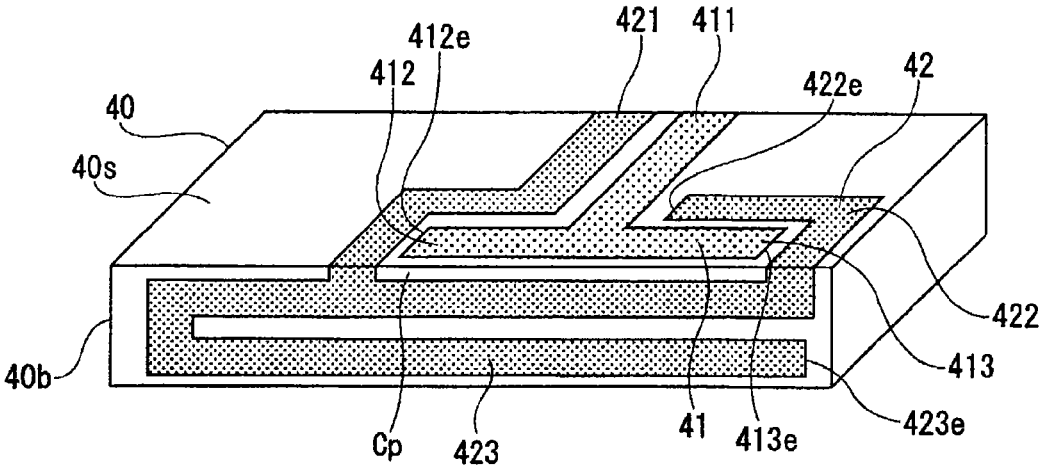
FIG. 16 illustrates an exemplary example depicting the configuration of the radiating element and a coupling unit on multiple sides of the housing resin.

FIGS. 15 and 16 depict the configuration of the electric power feeding element and the radiation element of the antenna system wherein two surfaces of the housing resin incorporate the radiating element and/or the capacitive coupling element.

FIG. 15 illustrates in non-limiting example depicting a part of the radiation element being formed on the side surface (40*b*) of the housing resin 40. Specifically, a longitudinal arm 423 of the radiating element is formed on the surface 40*b* of the housing resin 40. Note that in the base part 411 of the electric power feeding element 41, the front part 412 and 413 and the capacitive coupling part 422 of the radiating element 42 are formed on the surface 40*s* of the housing resin.

FIG. 16 depicts a non-limiting example illustrating a part of the radiating element and a part of the capacitive coupling unit formed on the side surface of the housing resin. In the base part 411 of the electric power feeding element 41, the front part 412 and 413 and the capacitive coupling part 422 of the radiating element 42 are found on the upper surface of the housing resin. A part of the capacitive coupling formation 422 are the terminals 412*e* (the front end part of 412 of the electric power feeding device 41) and the terminals 413*e* (the front part 413 of the electric power feeding device 41) are formed on the surface 40*s*. The area between the top region of the electric power feeding element 41 and the capacitive coupling part 422 (denoted by Cp) is formed on the side surface of the housing resin.

Figure 17:
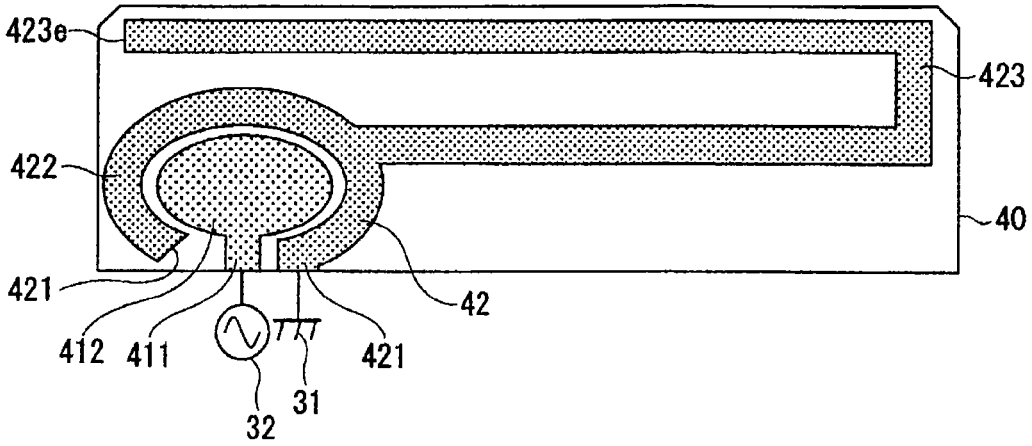
FIG. 17 illustrates a non limiting example depicting the configuration of a circularly shaped feeding element.
Figure 18:
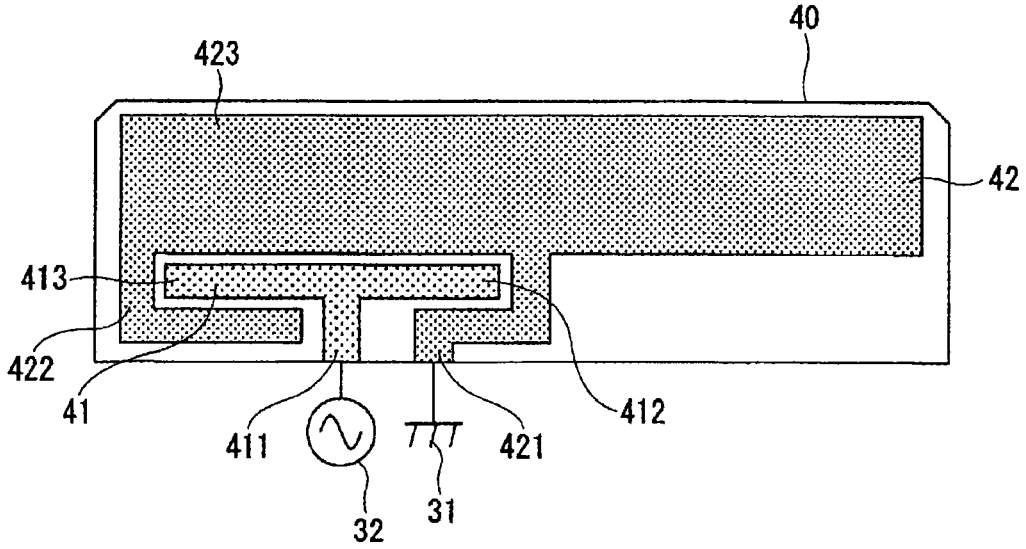
FIG. 18 illustrates a non-limiting example depicting an integral configuration of the radiating element and a capacitive coupling unit.

FIGS. 17 and 18 illustrate variations in the manner the capacitive coupling is formed between the radiating element and the electric power feed element. Specifically, FIG. 17 illustrates a circularly shaped electric power feeding element. Note that the shape of the electric power feeding is not restricted to an L-shaped or a T-shaped unit. Further, note that when the electric power feeding element is constructed in this way, the capacitive coupling part 422 of the radiating element is also made in a circular shape along the outer periphery of the front end 412 which is formed circularly.

FIG. 18 illustrates an example wherein the radiation element is formed integrally with the capacitive coupling formation unit. In order to achieve this configuration, the space between the radiation part 423 of the radiating element 42 and the capacitive coupling formation part 422 as depicted in FIG. 2 is filled with a metallic substance. In other words, by completely filling the hollow part between the parts 423 and 422 of FIG. 2 with a metallic substance, the configuration of FIG. 18 is achieved.

Figure 19:
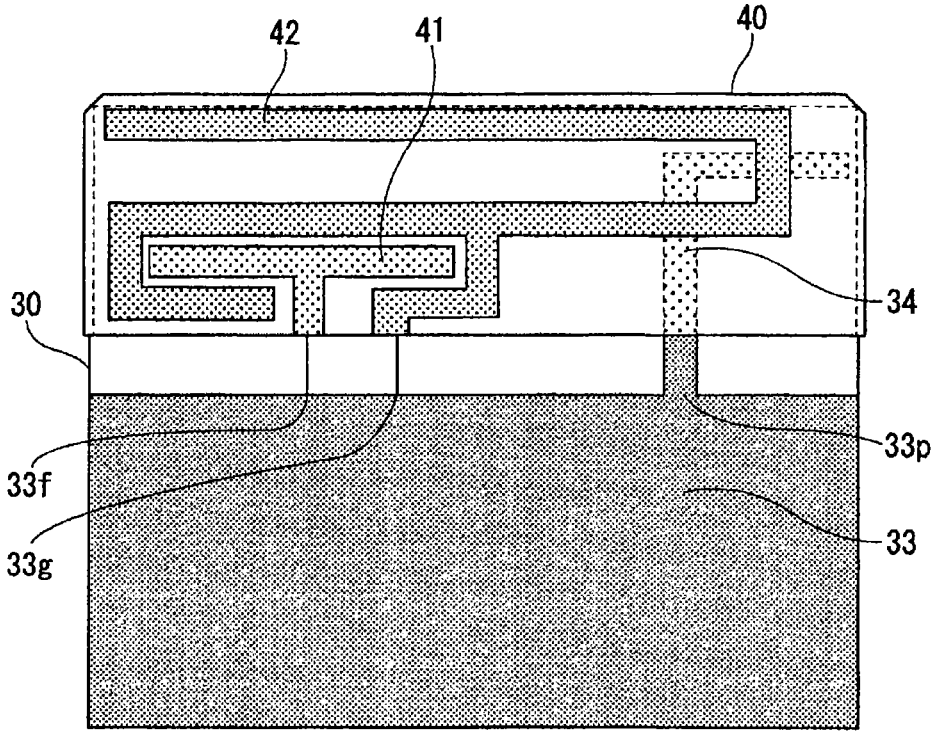
FIG. 19 illustrates the formation of a parasitic element on a circuit board.

FIG. 19 depicts a non-limiting example illustrating the formation of a parasitic element 34 that is formed on the circuit board 30. The parasitic element is formed by etching on a signal layer and connecting one end of the parasitic element to the ground layer 33*b*. Note that this formation of the parasitic element by etching on the signal layer also functions as an antenna element. Further, since the electric power feeding element 41 and the radiating element 42 are formed on the housing resin 40, which is on a layer different from the circuit board 30, it is possible to position the parasitic element 34 three-dimensionally with respect to the feeding element 41 and radiating element 42. This further provides flexibility in designing the antenna system.

Obviously numerous modifications and variations of the present invention are possible in light of the above teachings. It is therefore to be understood that given the scope of the appended claims the invention may be practiced otherwise than as specifically described herein.

For example, a component such as a lumped constant can be inserted between the radiating element connection spring 51*r* and the ground terminal 31. The connection housing resin 40 that comprises the antenna element and the circuit board 30 is however not limited to a spring. A moveable probe pin such as a focal pin or an electroconductive metal shape or the like can be used. Further, the electric feeding element and the radiating element may be formed as a pattern on a flexible printed circuit board and the flexible printed circuit board can be affixed on the housing resin 40. Furthermore, one can completely eliminate the use of the housing resin 40 and form the electric power feeding unit 41 and the radiating element 42 only with metal sheets and a wire.

Note that the value of the capacitive coupling unit Cp in the present disclosure was assumed to be between 0.1 picofarad to 5 picofarad. However, this is not limiting the scope of the present invention and any other value may be set as the capacitive coupling value. Further, the coupling adjustment element can comprise an inductor and a filter that pass/block a predetermined frequency band. Note that when the coupling adjustment element comprises a filter and an inductor, the filter is operated as in a capacitive nature at high frequencies and in an inductive nature at low frequencies. Specifically, since the coupling amount of the capacitive coupling part can be adjusted at the operating frequency bands of the antenna, the degree and freedom of designing further improves. Note that the frequency bands that are passed/blocked by the antenna may include a plurality of filters and a switch that can select the operating frequency of the antenna by appropriately selecting the frequency pass bands. Further, note that when the capacity of the capacitive coupling part can be fully obtained by adjusting the length of the electric feeding unit 41, it is not necessary to provide the coupling adjustment element. Additionally, devices other than the mobile phone terminal device as described in the present disclosure may also be used to perform the features discussed in the present disclosure. For example, aspects of the present disclosure may be executed on a Smartphone, a tablet, or the like. The above disclosure also encompasses the embodiments noted below:

(1) An antenna comprising: a circuit board including a feed circuit and a ground terminal; a radiating element formed on a dielectric substrate positioned above the circuit board; a feed element formed on the dielectric substrate, the feed element disposed within an outer periphery defined by the radiating element; a first conductive element that connects the feed element to the feed circuit; and a second conductive element that connects the radiating element to the ground terminal.

(2) The antenna of (1), wherein the feed element and the radiating element are formed of a metal on the dielectric substrate.

(3) The antenna of (1), wherein the dielectric layer is located at a predetermined distance from the circuit board and attenuates an electrical interference from components mounted on the circuit board.

(4) The antenna of (1), wherein the first conductive element and the second conductive element are elastic connection springs.

(5) The antenna of (1), further comprising: a capacitive adjustment element formed on a transmission line that connects the feed circuit and the ground terminal.

(6) The antenna of (1), wherein a part of the radiating element overlaps a part of the feed element forming a capacitive coupler.

(7) The antenna of (1), wherein an effective capacitance of the antenna includes a first capacitance of the capacitive coupler and a second capacitance of the capacitive adjustment element.

(8) The antenna of (7), wherein the effective capacitance of the antenna is a constant of a matching circuit.

(9) The antenna of (1), wherein the radiating element emits a current transmitted from the feed element as a radio wave through the capacitive coupler.

(10) The antenna of (1), wherein a tip of the radiating element is located at a predetermined distance from a tip of the feed element to form the capacitive coupler.

(11) The antenna of (1), wherein the capacitive adjustment element is configured to block a first set of predetermined frequencies and pass a second set of predetermined frequencies.

(12) The antenna of (1), wherein the capacitive adjustment element is selected from the group consisting of capacitor, inductor and filter.

(13) The antenna of (1), wherein the feed element and the radiating element are formed on multiple surfaces of a dielectric slab.

(14) The antenna of (1), further comprises a parasitic element formed on the circuit board and connected at one end to the ground terminal.

(15) The antenna of (1), wherein the first conductive element is connected to the feed circuit by a first conductive wire and the second conductive element is connected to the ground terminal by a second conductive wire.

(16) The antenna of (15), wherein the first conductive wire and the second conductive wire are separated by a distance equal to quarter of an operating wavelength.

(17) A terminal device comprising: a circuit board including a feed circuit and a ground terminal; an antenna unit including a radiating element formed on a dielectric substrate positioned above the circuit board; and a feed element formed on the dielectric substrate, the feed element disposed within an outer periphery defined by the radiating element; a first conductive element that connects the feed element to the feed circuit; and a second conductive element that connects the radiating element to the ground terminal.

The invention claimed is:

1. An antenna comprising:

a circuit board including a feed circuit and a ground terminal;

a radiating element having a first portion formed on a top surface of a dielectric substrate that is positioned above and at least partially overlaps the circuit board, and a second portion formed on a side surface of the dielectric substrate;

a feed element formed on the top surface of the dielectric substrate, the feed element disposed within an outer periphery defined by the first portion of the radiating element;

a first conductive element that connects the feed element to the feed circuit;

a second conductive element that connects the radiating element to the ground terminal; and a capacitive adjustment element having a first end directly connected to a first line connecting the feed circuit to the first conductive element and a second end directly connected to second line connecting the radiating element to the ground terminal.

2. The antenna of claim 1, wherein the feed element and the radiating element are formed of a metal on the dielectric substrate.

3. The antenna of claim 1, wherein the dielectric layer is located at a predetermined distance from the circuit board and attenuates an electrical interference from components mounted on the circuit board.

4. The antenna of claim 1, wherein the first conductive element and the second conductive element are elastic connection springs.

5. The antenna of claim 1, wherein a part of the radiating element overlaps a part of the feed element forming a capacitive coupler.

6. The antenna of claim 5, wherein an effective capacitance of the antenna includes a first capacitance of the capacitive coupler and a second capacitance of the capacitive adjustment element.

7. The antenna of claim 6, wherein the effective capacitance of the antenna is a constant of a matching circuit.

8. The antenna of claim 5, wherein the radiating element emits a current transmitted from the feed element as a radio wave through the capacitive coupler.

9. The antenna of claim 5, wherein a tip of the radiating element is located at a predetermined distance from a tip of the feed element to form the capacitive coupler.

10. The antenna of claim 1, wherein the capacitive adjustment element is configured to block a first set of predetermined frequencies and pass a second set of predetermined frequencies.

11. The antenna of claim 1, wherein the capacitive adjustment element is selected from the group consisting of capacitor, inductor and filter.

12. The antenna of claim 1, wherein the feed element and the radiating element are formed on multiple surfaces of the dielectric substrate.

13. The antenna of claim 1, further comprises a parasitic element formed on the circuit board and connected at one end to the ground terminal.

14. The antenna of claim 1, wherein the first conductive element is connected to the feed circuit by a first conductive wire and the second conductive element is connected to the ground terminal by a second conductive wire.

15. The antenna of claim 14, wherein the first conductive wire and the second conductive wire are separated by a distance equal to quarter of an operating wavelength.

16. A terminal device comprising:

a circuit board including a feed circuit and a ground terminal;

an antenna unit including a radiating element having a first portion formed on a top surface of a dielectric substrate that is positioned above and at least partially overlaps the circuit board, and a second portion formed on a side surface of the dielectric substrate;

a feed element formed on the top surface of the dielectric substrate, the feed element disposed within an outer periphery defined by the first portion of the radiating element;

a first conductive element that connects the feed element to the feed circuit;

a second conductive element that connects the radiating element to the ground terminal; and a capacitive adjustment element having a first end directly connected to a first line connecting the feed circuit to the first conductive element and a second end directly connected to second line connecting the radiating element to the ground terminal.

17. The antenna of claim 1, wherein the circuit board and the dielectric substrate are separate planar structures disposed in a parallel configuration.

18. The antenna of claim 1, wherein the radiating element and the feed element formed on a dielectric substrate are positioned above and at least partially overlap the circuit board.

19. The terminal device of claim 16, further comprising:

a substantially rectangular housing, wherein the circuit board and the dielectric substrate are separate planar structures disposed in a parallel configuration so as to at least partially overlap when viewed from a front surface of the housing.

20. The antenna of claim 1, wherein the capacitive adjustment element consists of one of a capacitor, an inductor or a filter.

* * * * *